US005964628A

United States Patent [19]

Scanlon et al.

[11] Patent Number: 5,964,628

[45] Date of Patent: Oct. 12, 1999

[54] COLLAPSIBLE PERSONAL FLOTATION DEVICES

[76] Inventors: Robert E. Scanlon, 18304 W. Rim Dr., Jonestown, Tex.; Timothy M. Scanlon, 11401 Barrington Way, Austin, Tex. 78759

[21] Appl. No.: 08/889,231

[22] Filed: Jul. 8, 1997

[51] Int. Cl.[6] ..... B63B 7/04

[52] U.S. Cl. ..... 441/129; 114/354

[58] Field of Search ..... 114/353, 354, 114/363; 441/129, 130

[56] References Cited

U.S. PATENT DOCUMENTS

| | | | |
|---|---|---|---|
| 2,577,970 | 12/1951 | Larsson et al. | 114/353 |
| 2,946,068 | 7/1960 | Jasper | 9/347 |
| 3,158,299 | 11/1964 | Weir et al. | 114/354 |
| 3,648,309 | 3/1972 | Novakovich | 114/354 |
| 3,981,035 | 9/1976 | Iwabuchi | 114/354 |
| 4,275,473 | 6/1981 | Poirier | 9/13 |
| 4,869,551 | 9/1989 | Lathers | 114/363 |
| 5,052,965 | 10/1991 | Klapp et al. | 441/130 |
| 5,090,695 | 2/1992 | Ciolino | 272/144 |
| 5,149,314 | 9/1992 | Ciolino et al. | 482/111 |
| 5,176,554 | 1/1993 | Simmons | 441/129 |
| 5,314,395 | 5/1994 | Ciolino | 482/111 |
| 5,324,221 | 6/1994 | Kaufman et al. | 441/129 |

FOREIGN PATENT DOCUMENTS

| | | |
|---|---|---|
| 58889 | 9/1891 | Germany . |

*Primary Examiner*—Sherman Basinger

[57] ABSTRACT

The present invention describes a stable floating environment for an individual or cargo while at rest or under tow. The device, when occupied by an individual, allows the user to recline, lay prone or sit up right in any body of water. An important feature of the device is that it should possess a center of buoyancy above the center of mass of the occupant or cargo.

10 Claims, 6 Drawing Sheets

COLLAPSIBLE PERSONAL FLOTATION DEVICES

BACKGROUND OF THE INVENTION

1. Field of the Invention

This invention relates generally to recreational flotation devices, and the configuration and methods of construction thereof. In particular, a buoyant recliner or chair which allows the user to sit upright or recline in any position is provided. The invention further allows the transportation of a cargo in a stable aquatic environment. The device in one embodiment may safely be towed by a marine vessel at a suitable speed with the addition of a ridged skin and appropriate tow point.

2. Description of Prior Art

The prior art describes a number of recreational floating chair and mattress like devices as well as flotation devices that can be towed. The prior art devices typically have required the center of buoyancy to be below the center of mass of the user or load, an attitude which is inherently unstable. In certain cases stability has been improved by placing flotation members in out-riggers to increase the overturning moment. Towed devices generally have been canvas covered vehicle tire inner tubes which require inflation and are bulky once inflated. Inner tubes or other towed devices usually are inflated prior to use with a large volume of air at modest pressures; inflation by lung power is precluded, and manually operated pumps are slow and tedious. Morover, once these devices are inflated they tend to displace and/or crowd the tow vessels passengers until deflated.

SUMMARY OF THE INVENTION

The present invention overcomes problems in the prior art by providing a stable flotation device in which the center of buoyancy of the device is above the center of mass of the occupant or cargo. Thus, the present invention provides a flotation device comprising a multitude of buoyant panels and a means of connecting the panels into a panel; wherein the panel array forms a cavity supporting an occupant disposed therein, wherein the center of mass of thc occupant disposed in the cavity is below thc center of buoyancy of the panel array.

In an open configuration, the device of the invention defines a cavity or other recess capable of supporting the hips or midsection of a person whose back or upper body portion is supported by the central panel. It is important that the cavity or recess is deep enough such that the center of mass of a person disposed in the recess is below the overall center of buoyancy of the panel array. When the device is used as a floating cargo carrier, the cargo occupies the recess in place of a person. In a closed or folded configuration, the panels are shaped and hinged or coupled to form a compact stack of panels suitable for transport, storage, and the like.

A preferred hinge or coupling for the panels is one which has sufficient play or tolerance to enable adjoining panels to swing relative to one another between their expanded and contracted positions, despite the thickness of the panels. It is important that the panels be bouyant, and in some instances the panels will tend to be thick. It is also beneficial that the panels be free to exercise individual buoyancy.

In one preferred embodiment, the device of the invention comprises a central panel and a plurality of pairs of complementary panels. The panels in each pair are positioned on opposing sides of the central panel and expand or contract relative to one another. In an expanded position complementary panels alongside the central panel preferably tend to encase an occupant or cargo. Complementary panels around the hips of an occupant act with the central panel to define a seat or hammock-like recess.

In more particular embodiments, the flotation device further comprises a spine panel, a left back panel, a right back panel, a left side panel, a right side panel, a left bottom panel and a right bottom panel. In further embodiments the floating panel array comprises a spine panel having a left side, a right side, a top side and a bottom side, the bottom side having a left and a right component; a triangular left back panel having a side to conform to the length of and connected to the left side of the spine panel, the left back panel having a short side and a long side; a triangular right back panel having a side to conform to the length of and connected to the right side of the spine panel, the right back panel having a short side and a long side; a bottom left panel having a side to conform to the length of and connected to the bottom left side of the spine panel, the bottom left panel further having a right side and a left side; a bottom right panel having a side to conform to the length of and connected to the bottom right side of the spine panel, the bottom right panel further having a right side and a left side, wherein the left side conforms to the length of and is connected to the right side of the bottom left panel; an intermediate left panel having a side to conform to the length of and connected to the short side of the left back panel, the intermediate left panel further having a side to conform to the length of and connected to the left side of the bottom left panel; and an intermediate right panel having a side to conform to the length of and connected to the short side of the right back panel, the intermediate right panel further having a side to conform to the length of and connected to the right side of the bottom right panel.

In particular embodiments, the panels comprise a material selected from the group consisting of sheet closed cell foam, air filled bladders, waterproof sheet covered loose fill material, cork, wood, Lockform™, Styrofoam™, and Durafoam™.

In other embodiments, the hinge assembly comprises two nylon web loops each passing adjacent flotation panels conjoined by a flattened or round ring disposed between the spine, back, side and seat and bottom panels to allow for the collapse of the array to the approximate long dimensions of the largest panel.

In further embodiments, the flotation device may further comprise a thin external skin, having the same outline as each of the panels, the external skin having a triangular section keel attached to the spine.

In other embodiments the flotation device may further comprise a head rest. In more particular embodiments the head rest may be contoured to the shape of the cranium and neck. In other embodiments, the head rest may be adjustable to different proportions of various users by using Velcro® near the top side of the spine panel of the panel array. Of course Velcro® is only an exemplary material for attaching the head rest to the flotation device, other materials capable of reversibly attaching the head rest to the floatation device are envisioned to be useful for use in conjunction with the present invention.

In certain other embodiments the flotation device may further comprise an integral transportation shoulder strap which can be detached at one end and used to secure the device to a dock or vessel at rest where currents and winds may otherwise cause the occupant and/or device to drift.

The present invention also provides a dry double-ended collapsible dinghy comprising a multitude of buoyant panels; a means of connecting the panels into a panel array the means comprising sealed hinges and thwarts; and an external skin having the same outline as the panel array, the external skin having a triangular section keel attached to the spine; wherein the panel array forms a symmetric cavity supporting an occupant disposed therein, wherein the center of mass of the occupant disposed in the cavity is below the center of buoyancy of the panel array.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 5A is a front expanded view; FIG. 5B is a section view taken along the lines B—B of FIG. 5A. FIG. 5C is a view similar to FIG. 5B but with the two panels in a contracted position.

DESCRIPTION OF THE PREFERRED EMBODIMENT

Figure 1:
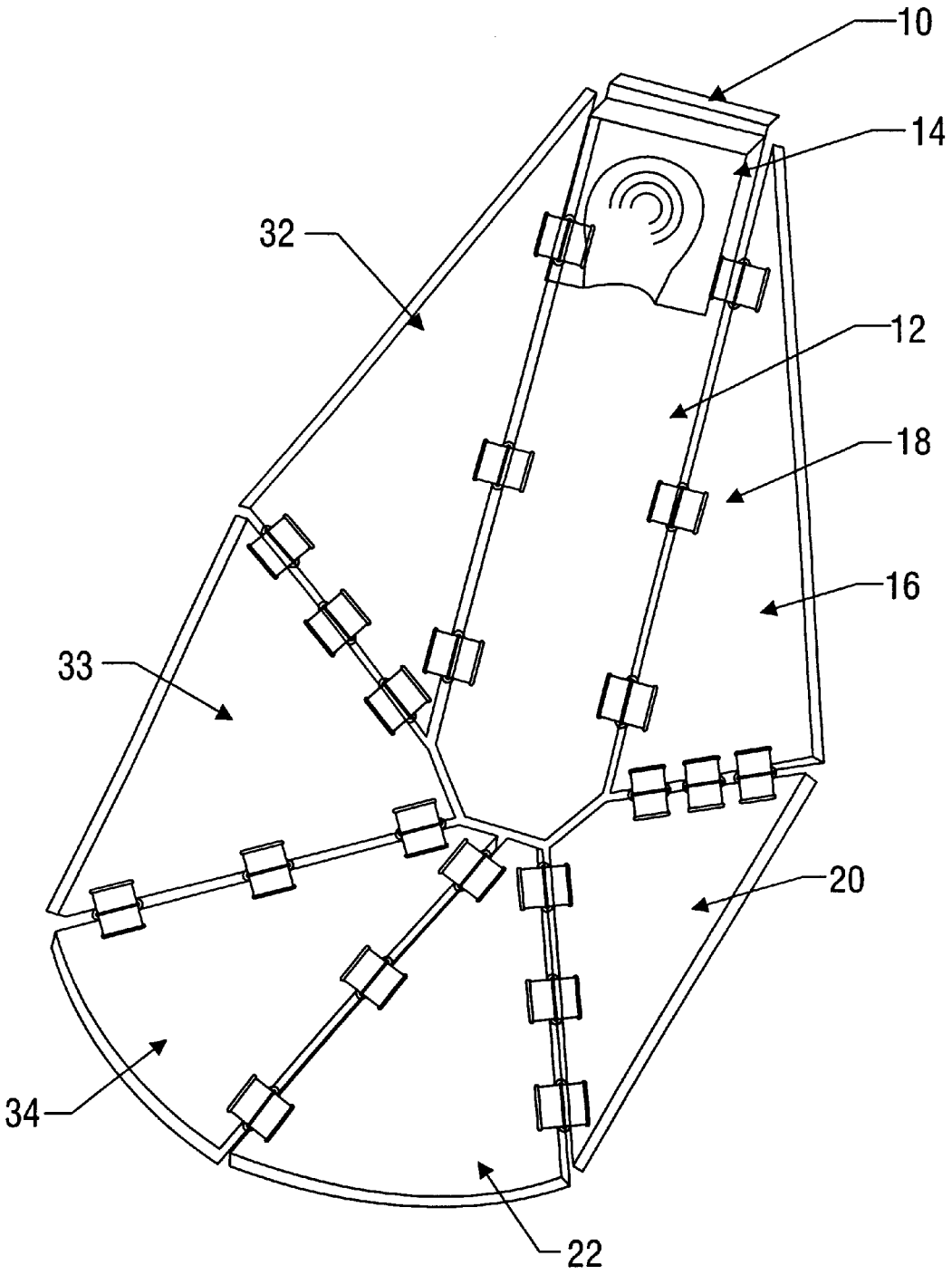
FIG. 1 is a perspective view of a device of the present invention in an expanded position taken slightly off to one side of a front view. A spine panel, 12, is attached to a left back panel 32 and a right back panel 16 by means of one or more hinge assemblies 18. Each of the side back panels 32 and 16 are attached to side a left side panel 33 and right side 20, respectively by means of one or more hinge assemblies 18. Each of said side panels 33 and 20 are attached to respective seat panels 34 and 22 by means of one or more hinge assemblies 18.

The present invention provides a stable floating environment for a individual or cargo while at rest or under tow. When occupied by an individual, the device allows the user to recline, lie prone or sit upright in a body of water. An important feature of the device is that it should possess a center of buoyancy above the center of mass of the occupant or cargo.

The flotation device in a preferred embodiment is comprised of an array of independent triangular panels constrained to a single degree of freedom relative to the overall assembly (i.e. rotation about the hinges). A triangle typically has its center of mass or buoyancy about one third the distance from the base of the triangle to the apex of the triangle. The triangular panels in the flotation device of the present invention are joined together in an array such that the bases of the panels are up and the apexes down in a liquid medium. Since the panels are independent of each other and not fused together, each such panel has its own center of buoyancy. Thus, a flotation device of the present invention forms an array of buoyant centers. If the panels were rigidly coupled together into a monolithic panel of uniform thickness, they would have a single center of buoyancy which would correspond with the geometric center of the monolithic panel. This is the scenario presented by a conventional flotation device, which is usually a rectangular panel with the center of buoyancy underneath the user. When the center of buoyancy is under the center of mass or user, the whole system is unstable making it more liable to overturn. Stability of the flotation device can be improved by increasing the overturning moment through the use of outriggers i.e. a wide float is more stable than a narrow float; however outriggers add to the size and complexity of the device.

The center of mass of a male occupant is generally located in the belt region or lower, the female center of mass is somewhat lower than that of the male. An array of buoyant centers in accordance with the present invention behaves somewhat like an inner tube but with one important difference. When the occupant places his trunk in the center of a tube and allows it to sink below the surface of the tube, the center of buoyancy of the tube remains in the middle of the tube. In the present invention the occupant places his center of mass below the center of buoyancy of an array of panels which constitutes a true buoyant collar with independent buoyant nodes placed about the user and above his center of mass. The occupant's trunk and center of mass are below the array of buoyant centers, since they are located in the lower two thirds of the device.

A device as described in the present invention is a further improvement over the prior art in that it is light weight, easily transported and stored. The device may be collapsed on itself to the size of the largest panel by means of a unique hinge shown in FIG. 5. A preferred hinge comprises a loop fabricated out of a wide but thin web, 35, which passes in turn through a slot 36, in a flotation panel, 20, and a plastic D ring, 37. This configuration is mirrored by an adjacent panel, 22, which shares the same D ring 37. The width of the gap between the panels 22 and 20 is defined by the width of the D ring 37.

Although a web and a D ring are shown and described in the preferred embodiment, any thin strip or round of suitable material with slots cut in them would perform the same function. Use of a single bar in place of the individual rings is envisioned as a means of stiffening the panels much like umbrella stays. This specific design allows for an infinitely variable pivot point for a hinge as opposed to a conventional hinge wherein the hinge point would be at one edge of the joint or in the middle. A pivot point at an edge will help make the joint tight when open and folded back on the adjacent panel but will only allow the panels to swing in one direction like a conventional door hinge. If a flexible hinge is placed in the center of the panel to allow two way operation the gap between the panels would have to be a minimum of one panel wide to allow for the panel thickness stack up when the panels are folded back on to each other. The slots in the panels to accommodate the web loop is placed far enough from the edges of the panels to gain sufficient shear area in the panel material to prevent tear out of the web loop. Another way to achieve this is to join a loop on one edge of a panel to a loop on the opposite edge of the panel with the same web material; when these loops are so conjoined across outside array of panels a strong web is formed which will more evenly distribute the load across the panels and eliminate the potential for tear out in the slots. This configuration is somewhat analogous to the ridged skin concept where the skin has slots which receive the web material in the same manner as the flotation panels. The advantage in this is that lighter more buoyant but weaker material may be used for the flotation panels and heavier loads may be placed in a device which is the same physical size.

In a further embodiment, a shoulder strap is provided for ease of transport.

Referring to the drawings, FIG. 1 shows a recreational flotation device generally designated by the number 10. In a preferred embodiment, configuration 10 is comprised of a narrow spine section 12, mounting a movable head rest 14, attached with Velcro. The device further comprises a left back panel, 32 and right back panel 16, each said panel coupled to the spine section by a connecting means 18. Each of the left and right back panels are coupled to a corresponding side panels 33 and 20, respectively. These side panels are coupled to a corresponding seat section panels 34 and 22, respectively.

Figure 5A:
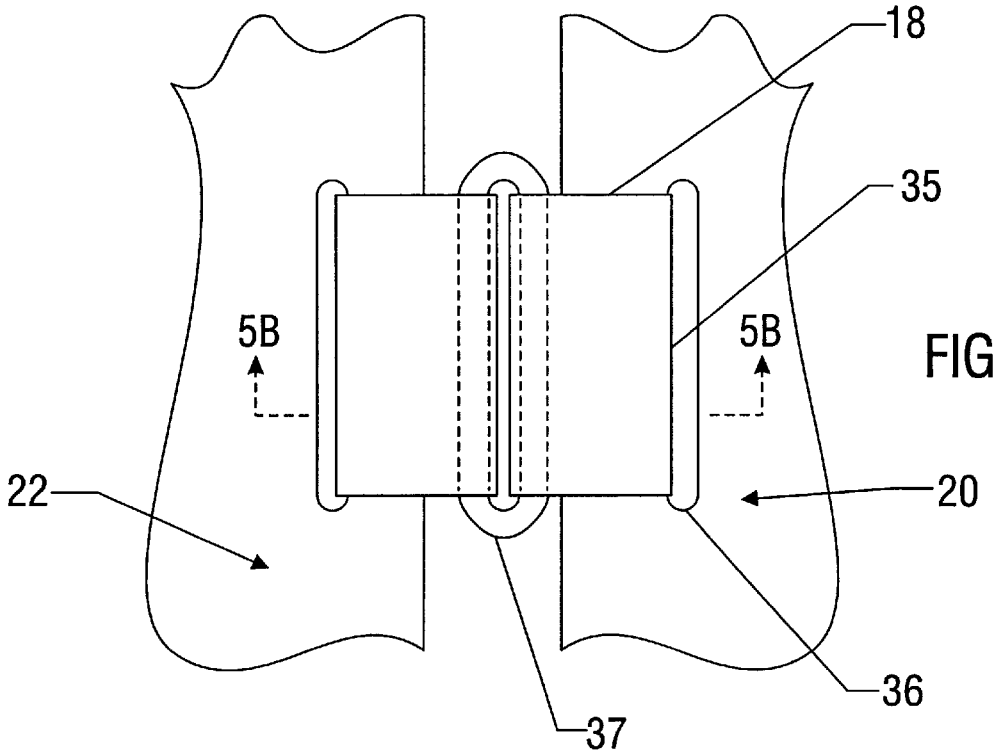
FIG. 5A, FIG. 5B and FIG. 5C show three views of a hinge assembly 18, which is comprised of a loop fabricated out of wide but thin nylon web, 35, which is passed through a slot 36, in a flotation panel, 20, and a plastic D ring, 37, in turn. This configuration is mirrored by an adjacent panel, 22, which shares the same D ring, 37. The width of the gap between the panels 22 and 20 is defined by the width of the D ring 37.
Figure 5B:
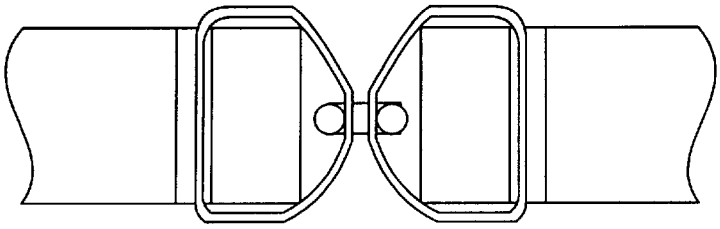
Figure 5C:
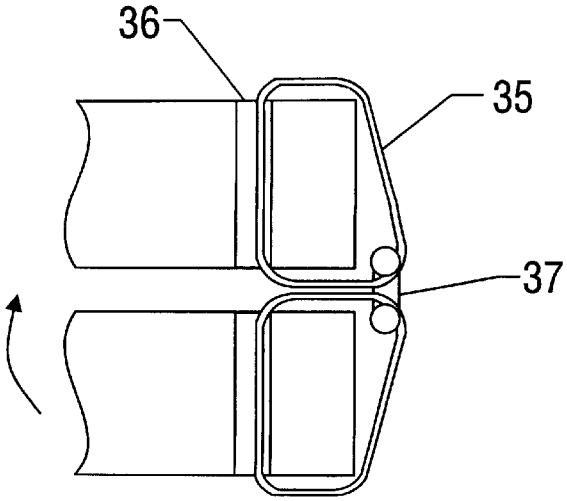

All the panels are joined into an array by the same connecting means, such that the various panels are afforded full and free articulation from the collapsed form to the open form shown in FIG. 1. In a preferred embodiment the connecting means comprises a hinge assembly as shown in FIG. 5.

The panels may be made of any buoyant material, for example, cork or light wood such as balsa wood. Alternatively, they may be hollow cans or boxes of sheet metal or plastic. Indeed, buoyancy may be provided by sheet closed cell foam, air filled bladders or waterproof sheet covered loose, lightweight fill material. A particularly useful material in this regard is solidified foam plastic, such as the preparation sold as Lockform™ Type B-605 by Nopco Chemical Co. (Hartford N.J.). This is a resin in liquid form which in use is mixed with a foaming agent and is molded into block form, in which shape it rapidly solidifies. Another material that can be used to advantage is air-expanded polyethylene or polystyrene, such as Styrofoam™.

In other embodiments, it is envisioned that the panels may comprise compartmentalized hollow vinyl containers which are capable of receiving buoyancy producing materials such as Durafoam™ closed cell flotation cushions. These compartments or pockets are arranged to permit the controlled distribution of the buoyant material to maximize comfort, balance and degree of buoyancy. Access to the compartments may be via a sealed opening, such as for example, through a zipper. The selection of the amount, shape and type of buoyant cushions to pack a float provides the user tremendous flexibility in customizing the floating panels to the user's particular needs in terms of stiffness and support. The outer shell of the panels may be comprised of Textra™ or other suitably water resistant material. As an alternative the compartments may be made of an air tight material and filled with air to create the requisite buoyancy. Other suitable materials for a flotation panel include closed sponge rubber including synthetic materials such as chloroprene or neoprene and commercially available products such as "Ensolite".

In a preferred embodiment, the panels are formed from closed cell foam which may be coated for appearance with colored vinyl but may be comprised of air filled panels or bladders, or loose buoyant fill material in a suitable covering and sealed, the nature of utilizing buoyant material, the various forms of incorporating flotation being well known to those skilled in the art.

A preferred panel configuration is comprised of, but not limited to, a series of triangular and or alternate shaped panels joined together by hinges previously described to form a hollow depression in the center of the device. Triangular panels are preferred due to the location of the center of buoyancy one third the height of the triangle measured from the base, although a variation in thickness will have the same effect. A series of triangles or truncated triangles readily lends itself to the formation of a hollow depression for the occupant or load. Triangular panels once so joined will form a ring of buoyancy about the load or user which will be inherently stable. Stability is required to counter wave action and free movement of the occupant with out fear of capsizing.

The arrangement of the buoyant panels is such that the device may be collapsed to the long dimensions of the largest panel for ease of transportation or storage. The assembly is collapsible by means of a wide web loop passed through slots in each adjoining panel, the loops then being conjoined by a ring. Referring to FIG. 5, for example a loop 35 is fabricated from a wide but thin nylon web, which is passed through a slot 36 in a flotation panel, 20, and a plastic D ring, 37, in turn. This configuration is mirrored by an adjacent panel, 22 which shares the same D ring 37. The width of the gap between the panels 22 and 20 is defined by the width of the D ring 37. Such a hinge design allows for panel thickness stack-up when collapsed while minimizing the gap between panels when unfolded. It further helps the panels to retain separate buoyant centers.

Figure 4A:
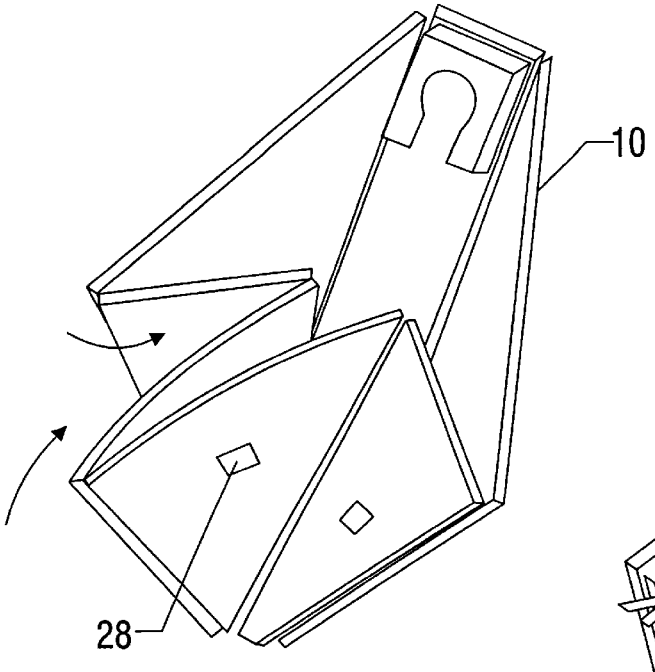
FIG. 4A, FIG. 4B and FIG. 4C show a flotation device fold sequence to a compact contracted position suitable for storage and transport. An integral shoulder strap 30 is provided for storage and transport, the strap may be detached to secure the device from drifting.
Figure 4B:
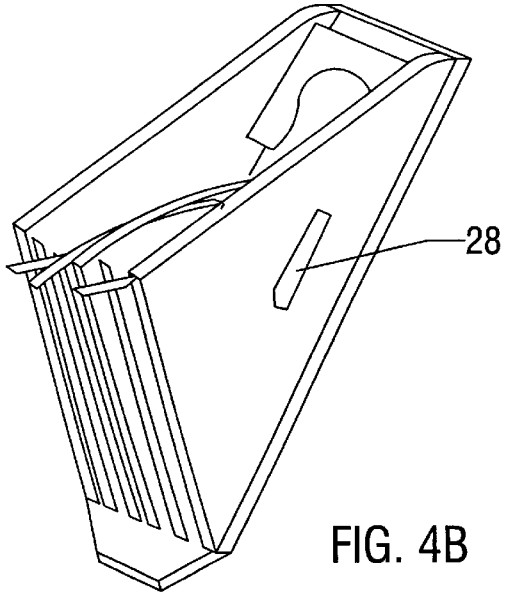
Figure 4C:
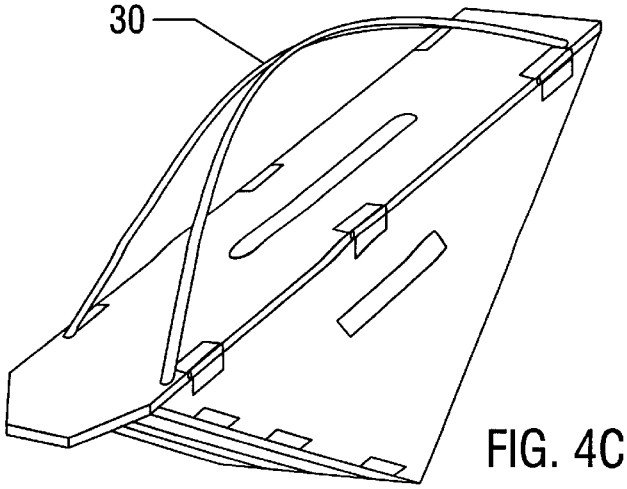
Figure 6:
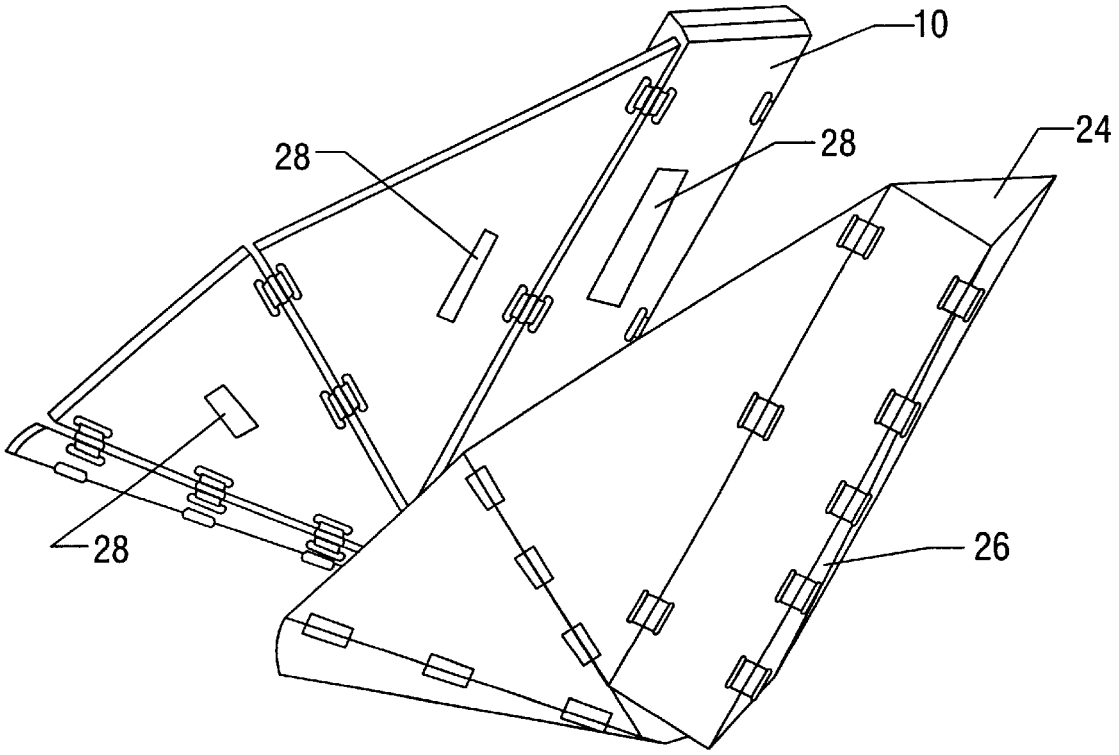
FIG. 6 shows a removable skin 24, attached for towing with the adjustable tow point towing keel, 26. The panels are held in the folded configuration by Velcro strips 28 which also serve to mount the flotation device to a ridged skin.

As shown in FIG. 4A, FIG. 4B and FIG. 4C, in a preferred embodiment, the individual panels are configured to collapse to the dimension of the largest panel. For ease of storage and transportation an integral shoulder strap 30 is provided; the strap may be detached to secure the device from drifting. The panels are held in the folded configuration by, for example, Velcro strips 28 which also serve to mount the flotation to a ridged skin as shown in FIG. 6.

Figure 2:
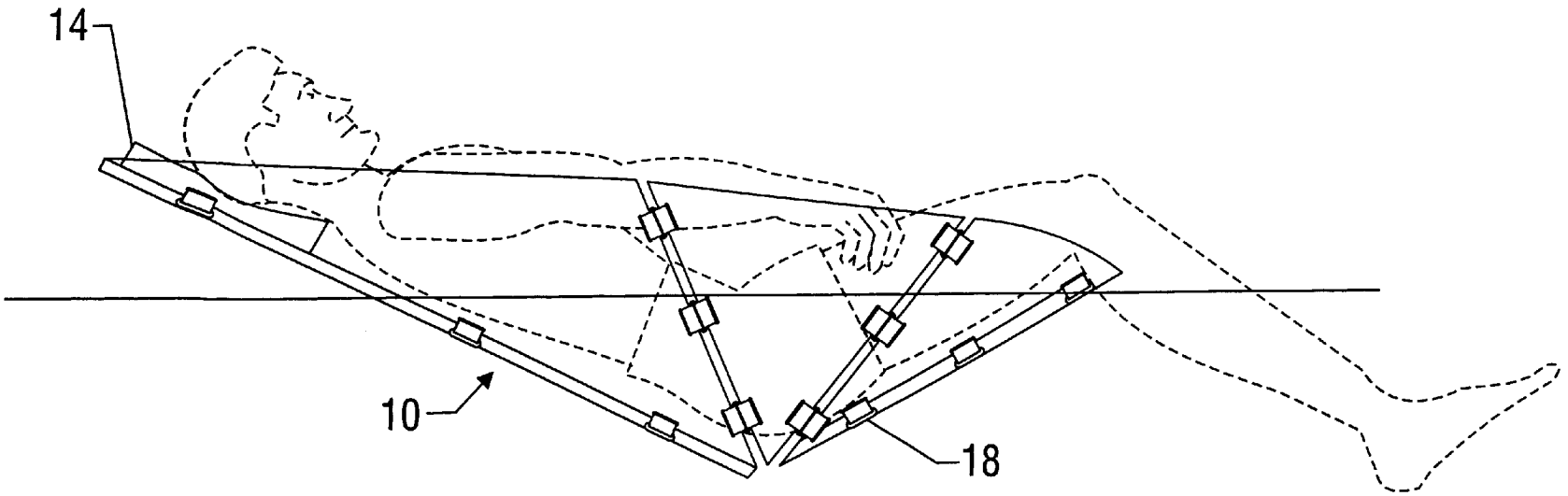
FIG. 2 is side view of a user reclining within the device at rest in water, wherein the side panels of the device are depicted as transparent.
Figure 3A:
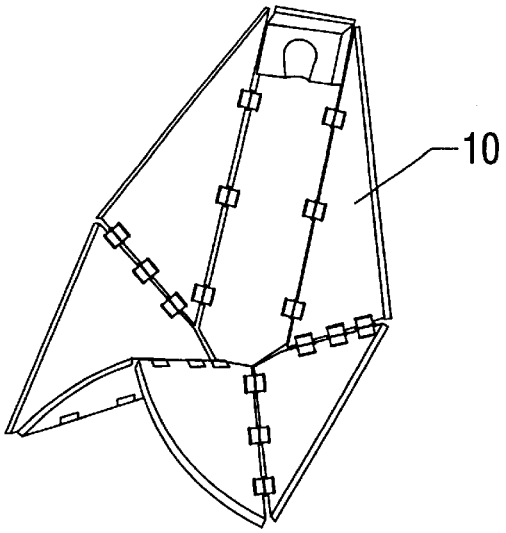
FIG. 3A is a perspective view of the device, with the device at rest in water ready to receive an occupant.
Figure 3B:
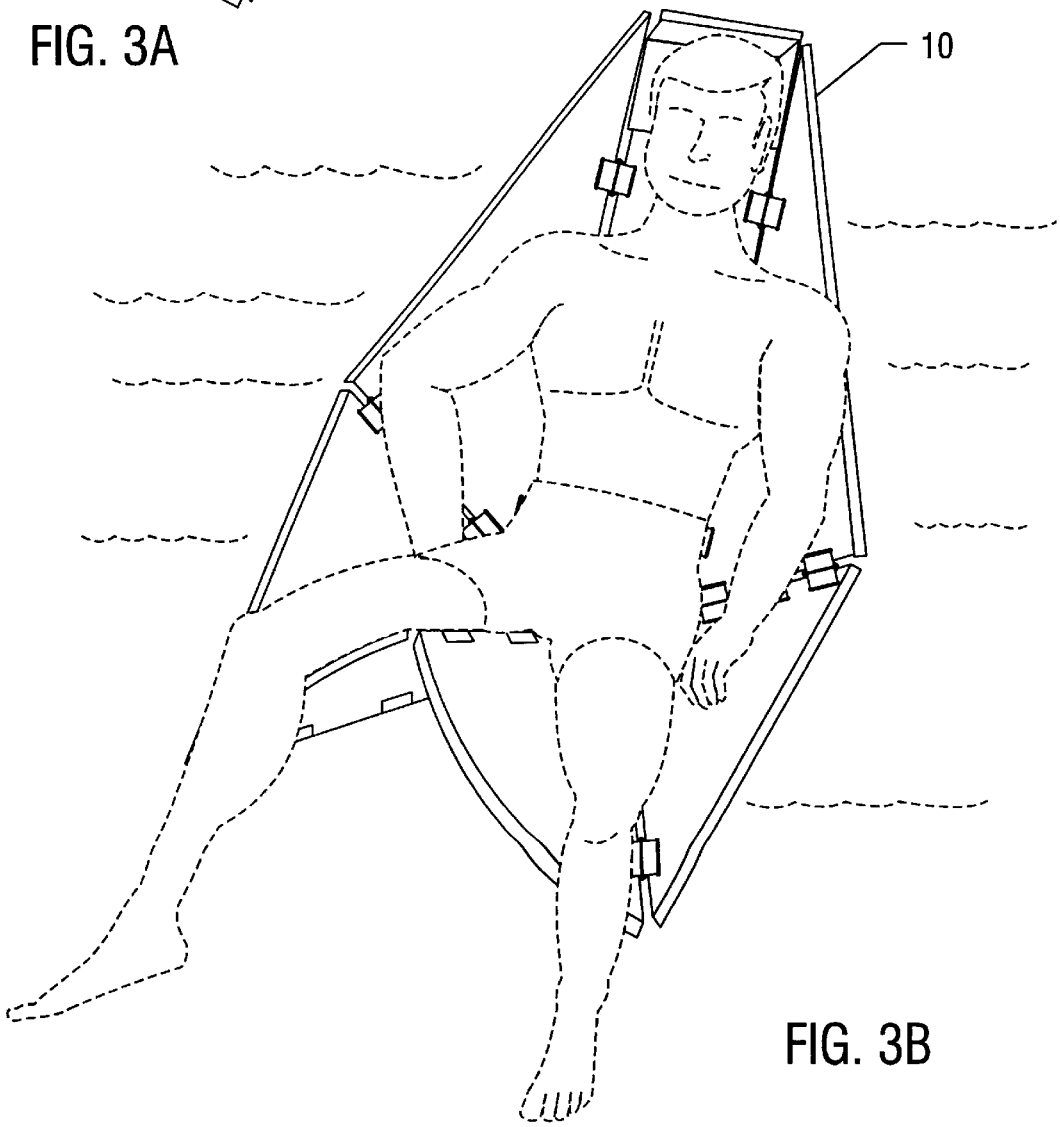
FIG. 3B is a view similar to FIG. 3A but with an occupant placed within the device.

In operation the device may be used to permit a user to recline as in FIG. 2, lay prone, or sit upright as in FIG. 3 by simply shifting his or her weight forward or back. When sitting up-right, the seat panels conveniently fold up between the legs of the user placing the center of buoyancy of these panels between and above the legs of the user. At the same time, the spine and back panels support the back of the user thus retaining the initial stability and giving fine control as shown in FIG. 3.

A towable configuration may be achieved by the addition of a thin external rigid skin tailored to be the same shape as the flotation panels and attached to the flotation device with Velcro or in a more permanent manner. The hinge joints may be open to the water or sealed to provide a drier environment for an occupant or load. In a preferred towable configuration as depicted in FIG. 6, a thin skin 24 is attached to the flotation panels as by means of Velcro 28, or by using the webbing of the hinge feature 18 for a more permanent arraignment. In order to tow the device, a rigid triangular beam 26 is preferably added to the spine of the device and attached to thin skin panel reinforcement previously mentioned. This distributes the load across the majority of the panels through the web hinges or through a separate panel hinge likewise tying together the ridged skin panels for the Velcro mounted configuration.

The skin may be constructed and arranged to maintain sufficient spacing between the panels to permit rolling and folding of the flotation device and also facilitates handling and storage. The outer skin may be formed of any material which is capable of maintaining the integrity and orientation of the device. Such materials should be resistant to abrasion and mechanical loading but need not be waterproof. Suitable materials include flexible reinforced fabrics, polyethylene polypropylene, polyvinyl chloride etc.

The buoyant panels may be sealed in the outer skin in any convenient manner. For example, the panels may be positioned upon a sheet of the material to be used to form the outer skin. A second sheet may be placed on top of the panels so that the top sheet falls between the edges of the panels and touches the bottom sheet. The two sheets may then be secured to one another by stitching, heat sealing, ultrasonic-sealing or any other convenient method.

While the invention has been particularly shown and described with reference to preferred embodiments thereof, it will be understood by those skilled in the art that changes in form and detail may be made therein without departing from the spirit and scope of the invention.

REFERENCES

The following references, to the extent that they provide exemplary procedural or other details supplementary to those set forth herein, are specifically incorporated herein by reference.

U.S. Pat. No. 5,324,221
U.S. Pat. No. 5,052,965
U.S. Pat. No. 5,314,395
U.S. Pat. No. 5,149,314
U.S. Pat. No. 5,090,695
U.S. Pat. No. 5,176,554
U.S. Pat. No. 2,946,068
U.S. Pat. No. 4,275,473

What is claimed is:

1. A flotation device comprising:

a) a multitude of buoyant panels;

b) a means of connecting said panels into a panel array; wherein said means of connecting comprise a hinge assembly said hinge assembly comprises two web loops each passing through adjacent bouyant panels conjoined by a flattened or round ring disposed between said panels; and wherein said panel array forms a cavity supporting an occupant disposed therein, wherein the center of mass of said occupant disposed in said cavity is below the center of buoyancy of said panel array.

2. The flotation device of claim 1, further comprising a spine panel, a left back panel, a right back panel, a left side panel, a right side panel, a left bottom panel and a right bottom panel.

3. The flotation device of claim 1, wherein said floating panel array comprises:

a) a spine panel having a left side, a right side, a top side and a bottom side, said bottom side having a left and a right component;

b) a triangular left back panel having a side to conform to the length of and connected to said left side of the spine panel, said left back panel having a short side and a long side;

c) a triangular right back panel having a side to conform to the length of and connected to said right side of the spine panel, said right back panel having a short side and a long side;

d) a bottom left panel having a side to conform to the length of and connected to the bottom left side of said spine panel, said bottom left panel further having a right side and a left side;

e) a bottom right panel having a side to conform to the length of and connected to the bottom right side of said spine panel, said bottom right panel further having a right side and a left side, wherein said left side conforms to the length of and is connected to said right side of said bottom left panel;

f) an intermediate left panel having a side to conform to the length of and connected to said short side of said left back panel, said intermediate left panel further having a side to conform to the length of and connected to said left side of said bottom left panel; and g) an intermediate right panel having a side to conform to the length of and connected to said short side of said right back panel, said intermediate right panel further having a side to conform to the length of and connected to said right side of said bottom right panel.

4. The flotation device of claim 3, further comprising an integral transportation shoulder strap which can be detached at one end and used to secure the device to a dock or vessel at rest where currents and winds may cause the occupant and/or device to drift.

5. The floatation device of claim 1, wherein said panels comprise a material selected from the group consisting of sheet closed cell foam, air filled bladders, waterproof sheet covered loose fill material, cork, wood, Lockform™, Styrofoam™, and Durafoam™.

6. The flotation device of claim 1, further comprising a thin external skin, having the same outline as each of said panels, said external skin having a triangular section keel attached to said spine.

7. The flotation device of claim 1, further comprising a head rest.

8. The flotation device of claim 7, wherein said head rest is contoured to the shape of the cranium and neck.

9. The flotation device of claim 7, wherein said head rest is adjustable to different proportions of various users by using Velcro near the top side of said spine panel of the panel array.

10. A dry double-ended collapsible dinghy comprising:

a) a multitude of buoyant panels;

b) a means of connecting said panels into a panel array said means comprising a hinge assembly which comprises two web loops each passing through adjacent buoyant panels conjoined by a flattened or round ring disposed between said panels; and c) an external skin having the same outline as the panel array, said external skin having a triangular section keel attached to said panel array;

wherein said panel array forms a symmetric cavity supporting an occupant disposed therein, wherein the center of mass of said occupant disposed in said cavity is below the center of buoyancy of said panel array.

* * * * *

UNITED STATES PATENT AND TRADEMARK OFFICE

CERTIFICATE OF CORRECTION

| | | |
|---|---|---|
| PATENT NO. | : | 5,964,628 |
| DATED | : | October 12, 1999 |
| INVENTOR(S) | : | Robert E. Scanlon and Timothy M. Scanlon |

It is certified that error appears in the above-identified patent and that said Letters Patent is hereby corrected as shown below:

Title page, item [54] and col. 1, line 2, delete "DEVICES" and insert-- DEVICE --.

Signed and Sealed this

Second Day of May, 2000

*Attest:*

Q. TODD DICKINSON

*Attesting Officer*

*Director of Patents and Trademarks*